United States Patent [19]

Pavlik et al.

[11] 4,158,561

[45] Jun. 19, 1979

[54] METHOD FOR PREPARING OXIDE COATED MICROLAMINATION PARTICLES

[75] Inventors: Norman M. Pavlik, Wilkins Township, Allegheny County; John Sefko, Monroeville, both of Pa.

[73] Assignee: Westinghouse Electric Corp., Pittsburgh, Pa.

[21] Appl. No.: 896,533

[22] Filed: Apr. 14, 1978

[51] Int. Cl.[2] ..... H01F 1/09

[52] U.S. Cl. ..... 75/0.5 BA; 148/6.35; 148/16; 148/105

[58] Field of Search ..... 148/105, 104, 6.35, 148/16, 31.55; 75/0.5 BA

[56] References Cited

U.S. PATENT DOCUMENTS

| | | | |
|---|---|---|---|
| 2,937,964 | 5/1960 | Adams et al. | 148/105 |
| 3,235,675 | 1/1966 | Blume | 179/115 |
| 3,255,052 | 6/1966 | Opitz | 148/105 |
| 3,418,710 | 12/1968 | Seidel et al. | 148/105 |
| 3,848,331 | 11/1974 | Pavlik et al. | 29/596 |
| 3,948,690 | 4/1976 | Pavlik et al. | 148/31.55 |

*Primary Examiner*—W. Stallard

*Attorney, Agent, or Firm*—L. P. Johns

[57] ABSTRACT

A method for preparing oxide coated microlaminations characterized by heating microlamination particles at a temperature of about 1375° in an atmosphere having a dew point of 55° to 85° F. and an air-to-natural gas ratio of from about 10.5:1 to about 8:1 for a time sufficient to decarburize the particles to less than 0.005% carbon and to form on the particle surfaces an oxide coating having a thickness of from about 0.01 to about 0.10 mils.

10 Claims, No Drawings

METHOD FOR PREPARING OXIDE COATED MICROLAMINATION PARTICLES

CROSS-REFERENCE TO RELATED APPLICATIONS

This invention is related to the copending applications Ser. No. 896,525, filed Apr. 14, 1978 by R. F. Krause, N, Pavlik, and K. A. Grunert; Ser. No. 896,526, filed Apr. 14, 1978 by R. F. Krause; Ser. No. 896,535, filed Apr. 14, 1978 by N. Pavlik and W. F. Reynolds; Ser. No. 896,534, filed Apr. 14, 1978 by R. F. Krause and N. Pavlik; and Ser. No. 896,536, filed Apr. 14, 1978 by R. F. Krause, N. Pavlik, and C. Eaves.

BACKGROUND OF THE INVENTION

1. Field of the Invention

This invention relates to magnetic cores formed from insulated microlamination particles and, more particularly, to such microlamination particles having a thin oxide coating on the surfaces.

2. Description of the Prior Art

Magnetic cores for power and high frequency uses are often produced from powdered metallic magnetic materials which comprise spheroids, flakes, and microlaminations. Flakes are usually made by flattening spheroid particles to a flake-like structure. Microlaminations are substantially flat, elongated, rectangular particles that are formed from plain carbon steel by cutting the same into discretely-shaped particles (elongated parallelopiped of generally rectangular cross-section) following which the microlaminations are decarburized, electrically insulated, and thereafter placed in a mold and pressed to the desired density without the use of a binder for producing the finished unitary magnetic core. Such powdered materials provide an economical method for production of magnetic cores which have low eddy current losses when subjected to high frequency excitation. Eddy current losses are reduced because of small particle size and high electrical insulation between the individual particles of the flakes. To obtain adequate core permeability, it is required that the insulation be sufficiently thin to provide a highly densified compact.

Heretofore, microlaminations have been provided with a coating of a suitable material, usually a magnesium oxide-based formation, for example, magnesium methylate, for providing electrical insulation between adjacent microlaminations in order to develop the required core loss characteristics in the finished product. U.S. Pat. Nos. 3,848,331 and 3,948,690 disclose the advantages and methods of applying such electrical insulation.

During a period of development of the use of insulated microlamination particles as material for magnetic cores, it had been the prevailing opinion that oxide coatings for insulating microlaminations from one another was not feasible because such oxides adversely affected the packing factor or density of the core produced from microlaminations. It was observed that the permeability exhibited by the core was adversely affected and became more severe as the frequency of the exciting current increased. Accordingly, it was a prevailing opinion that microlamination particles having oxide coatings were not suitably insulated from each other for use in magnetic cores and the like.

SUMMARY OF THE INVENTION

In accordance with this invention it has been found that oxide coatings on microlamination particles may be used satisfactorily where such coatings are sufficiently thin so as to not adversely affect the packing factor and therefore the ultimate permeability of a magnetic core. The method of this invention for preparing insulated microlamination particles for use as electrical components comprises the steps of placing a plurality of microlamination particles in a furnace, which particles are substantially of an elongated rectangular cross section and formed of a soft magnetic material. The particles are heated to a temperature range of from about 1350° to about 1450° F. while being maintained in an atmosphere having a dew point of 55° to 85° F. and an air-to-natural gas ratio within the range of from about 10.5:1 to about 8:1 for sufficient time to decarburize the particles to less than 0.005% carbon and to form on the particle surfaces an oxide coating of from about 0.01 to about 0.10 mils.

The advantage of the method of this invention is that an oxide layer is applied to the surfaces of each microlamination which, are sufficiently thin to insulate the particles and yet give proper packing densities when used in a magnetic core.

DESCRIPTION OF THE PREFERRED EMBODIMENT

The method of this invention for preparing insulated microlamination particles for use as electrical components, comprises the steps of placing a plurality of microlaminations in a furnace, which microlaminations are formed of a soft magnetic alloy of substantially an elongated rectangular cross section, and heating the particles to a temperature range of from about 1350° to 1450° F. in an atmosphere having a dew point of from 55° to 85° F., and having an air-to-natural gas ratio in the range of from about 10.5:1 to about 8:1 for sufficient time to decarburize the particles to less than 0.005% carbon, which atmosphere forms on the particle surfaces an oxide coating of from about 0.01 to about 0.10 mils in thickness.

The material from which the microlaminations are made is preferably a plain carbon steel normally of that type used for tin cans. This is a low carbon steel and is recommended because of its low cost and availability. The material is usually purchased in the form of "black plate", that is, the condition of the tin can steel prior to tinning. It is readily available in a wide range of thicknesses usually ranging from about 0.005 to about 0.020 inch in thickness. This black plate tin can stock material is one of the lowest cost ferrous products in this thickness range. Typically black plate which is AISI Type 1010 steel will have a composition containing between about 0.07% and about 0.13% carbon, about 0.30% to about 0.60% manganese, about 0.040% maximum phosphorus, about 0.050% maximum sulfur, and the balance essentially iron with incidental impurities. It is pointed out, however, that while the preferred material is a plain carbon steel, such other magnetic materials as silicon containing steels as well as nickel-iron, molybdenum permalloy, and other alloys may be employed in practicing the present invention.

It is preferred to have the steel with some degree of strength to it so that when the microlaminations are formed they do not become grossly distorted as will appear more fully hereinafter. Consequently, a plain carbon steel from about 0.05 to 0.15% carbon is ideally suited, for this material will have sufficient strength and yet is sufficiently ductile that the steel can be readily sheared into microlamination sizes as will be described. While exceedingly low carbon steels (more properly called "iron" can be employed, they are not recommended because of the tendency to distort during the microlamination formation operation. The plain carbon steel or other magnetic alloy is usually purchased in the cold rolled condition, the plain carbon steel preferably has a grain size of the order of ASTM No. 9. By employing the various magnetic materials in their cold worked condition, from which the microlamination can be formed, the resulting microlamination is in the form of a thin, elongated parallelopiped of substantially rectangular cross-section. The cold worked condition of the flat worked sheel material thus facilitates the formation and the retention of the as-formed shape. Moreover, the cold worked condition with its consequent higher strength and lowered ductility fosters a cleaner edge, (less burring) during the forming operation so that when the microlaminations are molded into the finished configuration, the tendency to pierce the insulation of adjacent particles is considerably reduced.

At the outset, it should be noted that while a wide range of steel particle sizes and thicknesses are satisfactory, it is nonetheless preferred to control the microlaminations to the form of a thin elongated parallelopiped of rectangular cross-section having dimensions between about 0.05 and about 0.20 inch in length, about 0.005 and about 0.05 inch in width and from about 0.002 to about 0.02 inch in thickness. Within this broad range, particularly satisfactory results have been obtained where the individual microlamination particle length ranges from about 0.050 to about 0.150 inch, from about 0.010 to about 0.030 inch in width and between about 0.006 and about 0.013 inch in thickness. The microlaminations are usually formed from the tin can stock to the foregoing dimensions by cutting with a high speed rotary die cutter as set forth in U.S. Pat. No. 3,848,331.

The second step comprises heating or annealing the particles to form an oxide coating of proper thickness on the surfaces of each particle which coating provides electrical insulation between adjacent particles. For that purpose the coating thickness may vary from about 0.01 to 0.1 mils. In any event, the thicknss must be less than 0.1 mil, the preferred thickness being 0.05 mil.

In accordance with this invention, the thin tightly adhering oxide layer or coating necessary for adequate electrical insulating properties of the microlamination particles is obtained under proper conditions of temperature, air-to-gas ratio, and dew point of the gas. The proper temperature range is from about 1350° to about 1450° F. with the preferred temperature being 1375° F.

The atmosphere used in the furnace during annealing is partly combusted natural gas containing about 82% nitrogen, 4% carbon monoxide, 9% carbon dioxide, 4% hydrogen, and about 1% argon. The foregoing components of the atmosphere may vary slightly from the indicated percentages, depending on the annealing temperature and the dew point of the atmosphere. During annealing the air-to-gas ratio has an operative range of from about 10.5:1 to about 8:1, with good results being from 10.5:1 to 9:1. Optimum results are obtained with the air to gas ratio being 9.5:1.

The dew point or water content has an operative range of 55° to 85° F., with the 85° F. temperature corresponding to the air to gas ratio limit of 8:1 and the 55° F. corresponding to the 10.5:1 air to gas ratio. Better results are obtained where the dew point varies from 75° F. to 80° F. with the preferred dew point being 75° F. and a corresponding air-to-gas ratio of 9.5:1.

The heating or annealing process may vary from 5 minutes to 4 hours, depending upon the heat transfer characteristics of the annealing furnace and method of charging, with up to 4 hours being required where the microlaminations are annealed in high density batches and as little as 5 minutes where the microlaminations are annealed in low density-highly dispersed masses. A rotary tube furnace is preferred for uniformity and the shorter time period. The best results for a thin adherent coating are obtained where the particles are decarburized to less than 0.005% carbon with maximum grain growth.

The following example is exemplary of the process of this invention.

EXAMPLE

Microlaminations having a size of 0.080 inch × 0.020 inch × 0.006 inch were annealed for 4 hours at 1375° F. (746° C.) in an exothermic, or partially combusted natural gas atmosphere having a dew point of 70° F. (21° C.) and an air-to-gas ratio of 10.5:1. The resulting microlaminations were then pressed into a compact core at 80,000 psi and tested for AC induction at 10 kG. For comparison, another test was run in which microlaminations were annealed for 4 hours at 800° C. in a hydrogen atmosphere and then coated with magnesium methylate prior to pressing at 80,000 psi into a core and test results are listed in Table I.

The microlaminations which were annealed in the exothermic atmosphere had a carbon content level of below 0.0035% carbon. Although the hydrogen annealed microlaminations had a lower carbon content (below 0.002%), the decarburization obtained with the exothermic atmosphere was adequate. The packing factor of the oxide insulated core (Speciman 1) was slightly better at 93.5% than the 93.0% (Speciman 2) of the hydrogen annealed, magnesium methylate coated core. This indicates that the oxide coating was sufficiently thin. When compared to the magnesium methylate insulated core, the core loss (W/lb) was greater (4.1 vs. 3.5) and the permeability was slightly lower (410 vs. 420), which indicates that the insulation value of the oxide coating is adequate but less than that of magnesium methylate coating.

Table II discloses results obtained on ring cores pressed with various microlamination sizes (Specimens 3–8) at pressures of 125,000 psi as compared with microlaminations insulated with magnesium methylate. Prior to pressing, the microlaminations were annealed, decarburized, and oxide insulated in one operation. The microlaminations were annealed for 2 to 5 hours at 746° C. in exothermic atmospheres of 9:1 to 10.5:1 air/gas ratio with dew points of 21° C. to 24° C. The cores were then pressed at 125,000 psi. Three companion cores (Specimens 9–11) were compacted from microlaminations which were annealed in hydrogen and insulated with magnesium methylate prior to pressing. First, the microlaminations annealed in the exothermic atmospheres were adequately decarburized (0.0025% to 0.0034% carbon). This is slightly higher than the $H_2$ annealed microlaminations but is adequate. Secondly, the oxide insulated cores had packing factors of 95.9 to 97.0% which compares favorably with the magnesium methylate insulated cores having packing factors of 95.7% to 96.7%. The magnetic properties of Specimens 3, 4, and 5 compare respectively with those of Specimens 9, 10, and 11.

In the summary comparison of Table III the oxide insulated cores are 24% to 30% higher in core loss and 12% to 32% lower in permeability. The oxide insulated specimens 6, 7 and 8 of varying microlamination geometries had permeabilities which were generally better than the permeabilities of the magnesium methylate insulated cores of specimens 9, 10 and 11 (470, 490, 600 vs. 460, 485, 580). However, the core loss of these cores are higher (3.9 to 5.7 vs. 3.1 to 3.7).

TABLE III-continued

Summary Comparison of Magnetic Properties of Oxide and Magnesium Methylate Insulated Cores Using Same Microlamination Sizes

| | $P_{c10}$ | | | 10 | | |
|---|---|---|---|---|---|---|
| Size | M.M.* | Oxide | % Diff. | M.M.* | Oxide | % Diff. |
| .013 .080×.020 × .006 | 3.1 | 4.0 | 29 | 580 | 440 | 32 |

*Magnesium Methylate

TABLE I

Comparison of Oxide and Magnesium Methylate Insulations in Pressed Microlamination Compacts Core Pressed at 80 Kpsi

| Specimen | Size | Anneal | Insulation | % C | Pressure Kpsi | Packing Factor, % | AC Induction: 10kG W/lb. | Perm. |
|---|---|---|---|---|---|---|---|---|
| 1 | .080×.020×.006 | 10.5/1 Exo.* 4 hr at 746° C., Bell Fce. 21° C. Dew Point | Oxide | .0025 to .0034 | 80 | 93.5 | 4.1 | 410 |
| 2** | .080×.020×.006 | $H_2$, 4 hr at 800° C. Btu Fce. | Magnesium Methylate | .0010 to .0018 | 80 | 93.0 | 3.5 | 420 |

*Exothermic Atmosphere.
**Data incorporated in U.S. Pat. No. 3,948,690.

TABLE II

Properties of Oxide and Magnesium Methylate insulated Microlaminations in Pressed Compacts. Cores Pressed at 125 Kpsi.

| Specimen | Size | Anneal | Insulation | % C | Packing Factor, % | AC Induction: 10 k W/lb | Perm. |
|---|---|---|---|---|---|---|---|
| 3 | .080×.020×.013 | 10.5/1 Exothermic 2 hr at 746° C., Tube Fce. 21° C. Dew Point | Oxide | — | 96.2 | 4.8 | 410 |
| 4 | .080×.030×.013 | Same as Above | Oxide | — | 96.2 | 4.6 | 410 |
| 5 | .080×.020×.006 | 10.5 Exothermic 2 hr at 746° C., Bell Fce. 21° Dew Point | Oxide | .0027 | 96.1 | 4.0 | 440 |
| 6 | .100×.010×.013 | 9.5/1 Exothermic 2 hr at 746° C., Bell Fce. 24° C. Dew Point | Oxide | .0027 | 96.3 | 5.7 | 470 |
| 7 | .150×.010×.013 | Same as above | Oxide | .0025 | 95.9 | 6.4 | 490 |
| 8 | .060×.020×.006 | 9/1 Exothermic 5 hr at 746° C., Roller Hearth 24° C. Dew Point | Oxide | .0033 | 97.0 | 3.9 | 610 |
| 9 | .080×.020×.013 | 4 Hr at 800° C. $H_2$ | Magnesium Methylate | .001 to .002 | 95.7 | 3.7 | 485 |
| 10 | .080×.030×.013 | 4 hr at 800° C., $H_2$ | Magnesium Methylate | .001 to .002 | 96.7 | 3.7 | 460 |
| 11 | 080×.020×.006 | 4 hr at 800° C., $H_2$ | Magnesium Methylate | .001 to .002 | 96.5 | 3.1 | 580 |

TABLE III

Summary Comparison of Magnetic Properties of Oxide and Magnesium Methylate Insulated Cores Using Same Microlamination Sizes

| | $P_{c10}$ | | | 10 | | |
|---|---|---|---|---|---|---|
| Size | M.M.* | Oxide | % Diff. | M.M.* | Oxide | % Diff. |
| .080×.020× .013 | 3.7 | 4.8 | 30 | 485 | 410 | 18 |
| .080×.030× | 3.7 | 4.6 | 24 | 460 | 410 | 12 |

In conclusion, the oxide insulated compacts compared to the magnesium methylate insulated compacts had magnetic properties which were nearly equivalent in permeability but generally poorer in core loss. The oxide insulation is adequate for lower efficiency applications or for high efficiency compacts where a choice of optimum microlamination geometry is available. The oxide insulation can be attained in one operation simultaneously with annealing and decarburizing in exothermic atmospheres. The oxide coating is preferred also because it is more economical than prior art coatings and it is safer because it is nonexplosive. Finally, adequate insulation value, space factor, and decarburization are obtainable in one operation.

What is claimed is:

1. A method of preparing insulated microlamination particles for use as electrical components, comprising the steps of (a) placing a plurality of particles of microlaminations in a furnace which particles are substantially of an elongated rectangular cross-section and of ferrous alloy, and (b) heating the particles to a temperature range of from about 1350° to about 1450° F. in an atmosphere having an air to natural gas ratio of from about 10.5:1 to about 8:1 for sufficient time to decarburize the particles to less than 0.005% carbon and to form on the particle surfaces an oxide coating of from about 0.01 to about 0.10 mils.

2. The method of claim 1 in which the atmosphere has a dew point of from 55° to 85° F.

3. The method of claim 2 in which the particles are heated for at least 5 minutes.

4. The method of claim 3 in which the air to natural gas ratio is from 9:1 to 10.5:1 and the dew point is 70° to 80° F.

5. The method of claim 4 in which the ratio is 9.5:1.

6. The method of claim 5 in which the due point is about 76° F. and the furnace temperature is about 1375° F.

7. A method of preparing compact cores of insulated microlamination particles for use as electrical components, comprising the steps of (a) forming microlaminations from thin, flat strips of ferrous alloys and of substantially rectangular shape, (b) heating said microlaminations in a temperature range of from about 1350° to 1450° F. in an atmosphere having an air to natural gas ratio of from about 10.5:1 to 8:1 for sufficient time to decarburize the particles to less than 0.005% carbon and to form on the particle surfaces an oxide coating of from about 0.01 to about 0.10 mils, and (c) compressing said microlaminations into a solidified configuration of the desired core component.

8. The method of claim 7 in which the atmosphere has a dew point of from 55° to 85° F.

9. The method of claim 8 in which the air to gas ratio is 9:1 to 10.5:1.

10. The method of claim 9 in which the dew point is about 76° F. and the furnace temperature is about 1375° F.

* * * * *